US005376751A

United States Patent [19]

Narita

[11] Patent Number: 5,376,751

[45] Date of Patent: Dec. 27, 1994

[54] AUTOPLAY APPARATUS AND METHOD PREVENTING CONTINUED OPERATION OF SOUND OPERATION/CONTROLLING MEANS DURING PAUSE

[75] Inventor: Taku Narita, Hamamatsu, Japan

[73] Assignee: Kawai Musical Inst. Mfg. Co., Ltd., Shizuoka, Japan

[21] Appl. No.: 7,895

[22] Filed: Jan. 22, 1993

[30] Foreign Application Priority Data

Jan. 22, 1992 [JP] Japan ..... 4-009517

[51] Int. Cl.[5] ..... G10H 1/26

[52] U.S. Cl. ..... 84/609; 84/649

[58] Field of Search ..... 84/609-614, 84/649-652

[56] References Cited

U.S. PATENT DOCUMENTS 4,924,745 5/1990 Kimpara et al. ..... 84/609

4,953,438 9/1990 Shibukawa ..... 84/609

*Primary Examiner*—Stanley J. Witkowski

*Attorney, Agent, or Firm*—Birch, Stewart, Kolasch & Birch

[57] ABSTRACT

According to the invention, in response to a pause designation the operational status of sound generator or controller is stored, while at the same time the operation of the sound generator or controller is released. Thus, after the stopping of the autoplay, the sound generator or controller is released from the state that existed before the pause. It is thus possible to preclude continuous operation of the sound generator or controller, which is an undesired operational state.

13 Claims, 6 Drawing Sheets

AUTOPLAY APPARATUS AND METHOD PREVENTING CONTINUED OPERATION OF SOUND OPERATION/CONTROLLING MEANS DURING PAUSE

BACKGROUND OF THE INVENTION

1. Field of the Invention

This invention relates to an apparatus for and a method of autoplay and, more particularly, to control of sound generating/controlling means such as pedals when affecting a pause in autoplay.

2. Description of the Prior Art

In a prior art autoplay apparatus, key number data and key on/off data are stored and are read out in the order of the play sequence to turn on and off keys corresponding to the key number data according to the key on/off data. In this case, a solenoid is provided under each key, and according to the above data it is: turned on/off to turn on or off the associated key.

In this autoplay apparatus, pedal data may be stored in addition to the key number data. Again in this case, pedal on/off data is read out to operate the solenoid of each pedal to effect the on/off operation of the pedal.

The above autoplay apparatus is also provided with command keys for controlling the autoplay. Among the control keys are a play key for starting autoplay, and a stop key for stopping the autoplay. Further, a pause key is provided to effect a pause in autoplay.

When the pause key is operated during autoplay, the play is stopped and the state thereof is held. This means that if the pause key is operated while a pedal is "on", this pedal is held "on" during the pause in the autoplay. That is, during this time the solenoid of the pedal is held to be operative and continuously carries current. This may result in over-heating of, and sometimes damage to, the solenoid.

This invention is intended to solve the above problem, and its object is, when autoplay is paused, that the state before the sound generating/controlling means of a pedal, etc. is continuously held, and the continuation of an undesired state is prevented.

SUMMARY OF THE INVENTION

According to the invention, in response to a pause designation, the status of operation of sold generating-/controlling means is stored, and at the same time the operation of the sound generating/controlling means is released. In response to cancellation of the pause, the stored operational status is read out, and the operation of the sound generating/controlling means is restored to the status existing immediately before the pause.

Thus, after stopping of autoplay the sound generating/controlling means is released from the state existing before the pause, thus preventing continued operation of the sound generating/controlling means, which is an undesired operational state. After cancellation of the pause of autoplay, the sound generating/controlling means is restored to the status existing before the pause, so that the autoplay can be resumed automatically from the state that existed immediately before the pause.

DETAILED DESCRIPTION OF THE PREFERRED EMBODIMENT

Summary of the Embodiment

Figure 1:
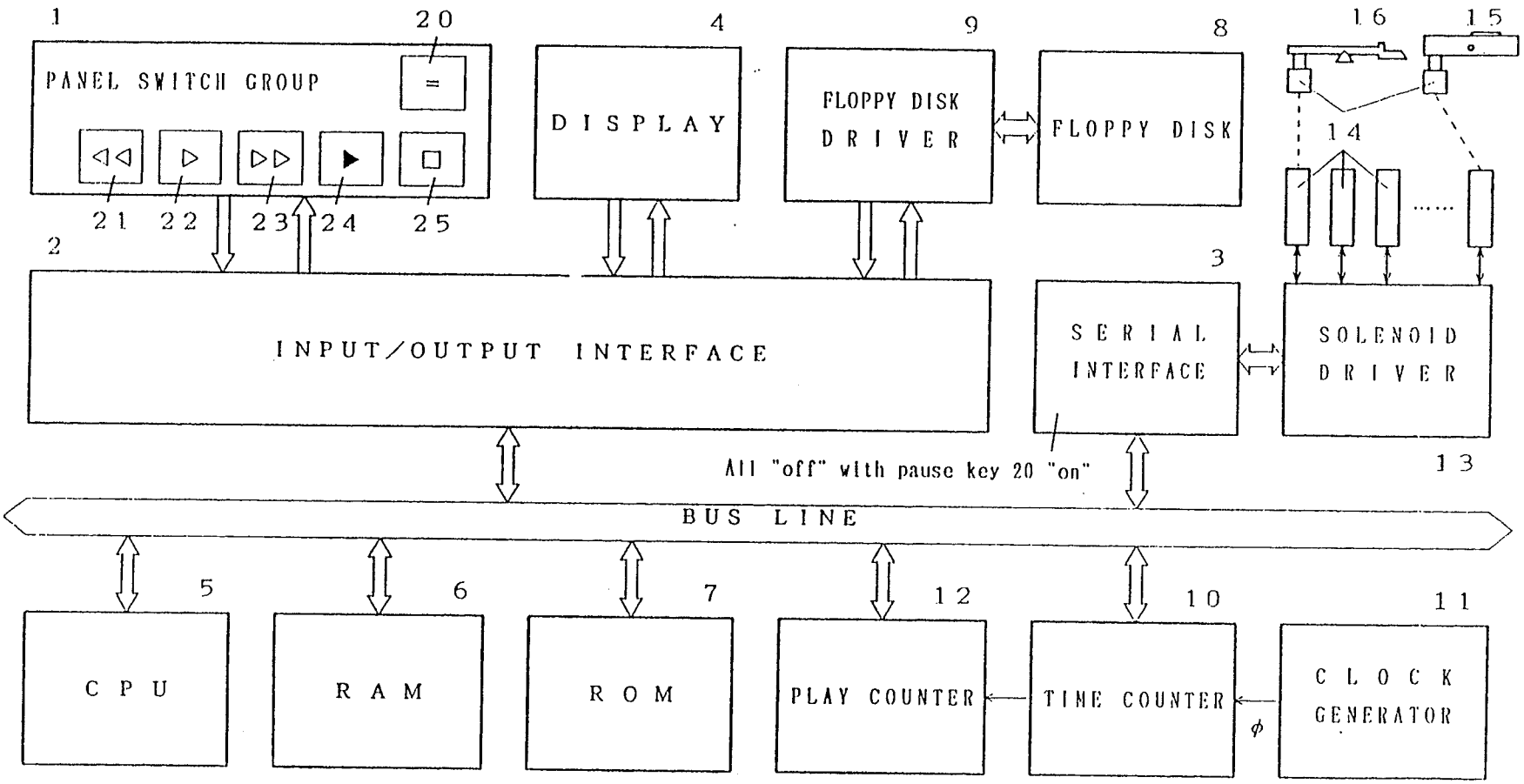
FIG. 1 is a block diagram showing the overall circuit of an autoplay piano.

When a pause key 20 is turned on in step 31 (labelled S31), all data in a serial interface 8 are cleared (34). This has an effect of prohibiting the continuous operation of the solenoids 14 for pedals 16 and keys 15 during the pause. At this time, data concerning the pedals 16 have already been stored in a pedal buffer register 83 (25). When the pause key 20 is turned on again (S33), data concerning the pedals 18, stored in the pedal buffer register 33, are supplied again to the serial interface 3 (06 and 07). This can results in restoration of the operational state of the pedal 18 to resume autoplay from the moment corresponding to the setting of the pause.

1. Overall Circuit

FIG. 1 shows the overall circuit of an autoplay piano which is one of apparatuses for autoplay. In a panel switch group 1, autoplay control instructions and so forth are carried out. Key data indicative of the operational status of each switch key in the panel switch group 1 is temporarily stored in an input/output interface 2 and supplied to CPU 5 for execution of a routine corresponding to each operated key. The key data has the same number of bits as the number of keys in the panel switch group 1, with, for instance, "1" being set as a bit corresponding to each operated key. The panel switch group 1 may be a type, in which a high level signal is output from a voltage source through an "on" key, or a type, in which keys are scanned according to a sampling signal. Data, information, address data, etc., are supplied through a bus line.

Display data supplied from the CPU 5 or the like through the input/output interface 2 is input to and displayed on a display 4. The displayed data indicates the operational status of the panel switch group 1 or the status of a routine being: executed by the CPU 5. Autoplay information API for each piece of music is stored on a floppy disk 8, and is loaded into the RAM 6 through a floppy disk driver 9 and an input/output interface 2, and autoplay is carried out. The autoplay information API in the RAM 6 is saved on the floppy disk 8.

Various data obtained as a result of processing in the CPU 5 are stored, in addition to the autoplay information API, in the RAM 6. In a ROM 7 are stored programs to be executed by the CPU 5 according to flowcharts to be described later, along with programs for other routines.

The CPU 5 sends music information MI from autoplay information API through the serial interface 3 to an autoplay piano or another musical instrument. In the autoplay piano solenoids 14 are provided, one for each key 15 and one of each pedal 16. When any solenoid 14 is energized, a corresponding key 15 or pedal 16 is turned on, and when that solenoid 14 is de-energized, the corresponding key 15 or pedal 16 is turned off. The CPU 5 reads out autoplay information API from the RAM 6 and supplies it to a solenoid driver 13 to energize or de-energize the corresponding solenoid 14. In this way, the autoplay of the piano is effected. As the pedals 16 are provided a damper pedal, a shifting pedal, a sostenuto pedal, a soft pedal, a mute pedal, etc., as well as a loudness pedal.

If data according to key number data KN and touch data TC are set in the serial interface 3, an operational current of a magnitude corresponding to the touch data TC is sent to the solenoid 14 corresponding to the key number data KN, through the solenoid driver 13. And if data set in the serial interface 3 corresponds to pedal data PD, an operational current for turning the solenoid 14 on-off in accordance with the pedal data PD is passed through the solenoid driver 13 to the solenoid 14.

A clock signal $\phi$ is input from a clock generator 11 to a time counter 10, the count of which is incremented by "+1" at specific time intervals, for example, every 5 milliseconds. In this way, progress time data PT is counted. The count of a play counter 12 is incremented by "+1" whatever the time counter 10 reaches a predetermined value, for example "100", i.e., every 500 milliseconds, to count the progress play data PP, at which time, the time counter 10 is cleared. As an alternative, it is possible to constitute the time and play counters 10 and 12 in the RAM 6 and to effect counting by incrementing the counters by "+1" during an interrupt process executed whenever the clock signal $\phi$ is changes to a high level.

Tempo data TP, which will be explained later, is supplied to the clock generator 11, which then outputs a clock signal $\phi$ at a frequency corresponding to the tempo data TP, so that autoplay speed changes in accordance with a set tempo. However, it is also possible to make the frequency of the clock signal $\phi$ constant.

The panel switch group 1 has a pause key 20, a rewind key 21, a play key 22, a forward key 23, a record key 24 and a stop key 25. The pause key 20, when operated one time, causes a temporary pause in autoplay, and when operated again, causes resumption of the autoplay from the point where autoplay was paused. The resumption of autoplay is possible even with the play key 22 in the on position. This temporary pausing of autoplay includes autoplay rewind and fast forward. The rewind key 21 is used to initiate autoplay rewind. The play key 22 is used to initiate normal autoplay. The forward key 23 is used to initiate fast forward autoplay. The record key 24 is used to initiate recording of autoplay information API. The stop key 25 is used to stop autoplay.

Although not shown, the panel switch group 1 also includes a load key, save key, power key, etc. The load key is used to load autoplay information API from the floppy disk 8 into the RAM 6. The save key is used to save the autoplay information API in the RAM 6 on the floppy disk 8. The panel switch group 1 also has a key group for setting tempo and a key group for music selection.

2. Autoplay information API

Figure 2:
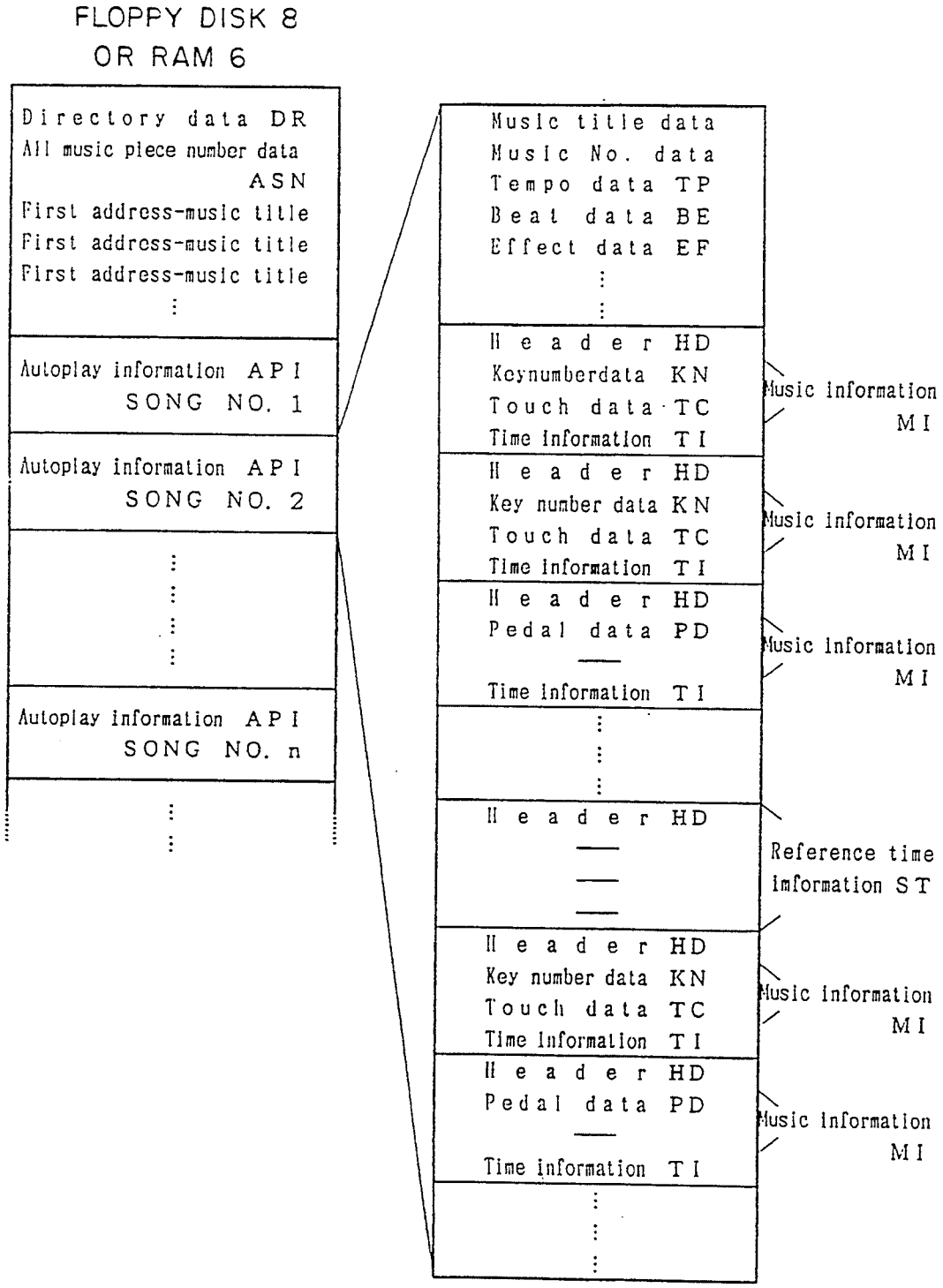
FIG. 2 is a view showing autoplay information API stored on a floppy disk 8 or in a RAM 6.

FIG. 2 shows autoplay information API stored on the floppy disk 8 or in the RAM 6. The autoplay information API comprises a plurality of sets including a header HD, music information MI and time information TI. The music information MI includes key number data KN, touch data TC and pedal data PD. The header HD is identification data for discriminating one set of music information MI and time information TI.

The key number data KN corresponds each of the keys 15 on the autoplay piano keyboard and indicates pitch information. The key number data KN includes data indicating a key-on "1" or key-off "0" state. The touch data TC, also called velocity data, and indicates the strength or speed of the on/off operation of the keys. The pedal data PD indicates each of the pedals 16 of the autoplay piano. The pedal data PD also includes data indicating a pedal-on "1" or pedal-off "0" state. The time information TI indicates the timing of execution of the music information MI. The music information MI and time information TI are stored on the floppy disk 8 in the order of the play sequence.

The autoplay information API includes reference time information ST. The reference time information ST indicates a point of reference "0" for the time information TI, and the time Information TI indicates the amount of time passed from the reference point. That is, the time information TI does not indicate relative time for immediately preceding music information MI but indicates absolute time. The reference time information ST may be replaced with bar mark data indicating the end of a bar.

The reference time information ST is read out and executed at specific time intervals, for example, when a count value of "100" is reached in the time counter 10, at 500 milliseconds intervals. At this time, the time counter 10 is cleared to "0", and the play time data is incremented by "+0.5". The reference time information ST comprises a header HD and three pieces of dummy data. The header HD identifies reference time information ST. The data format of the header HD of the reference time information ST is different from the format of the header HD of the music information MI. The automatic play information API may also include music title data, music number data, tempo data, beat data, effect data, etc.

3. RAM 6

Figure 3:
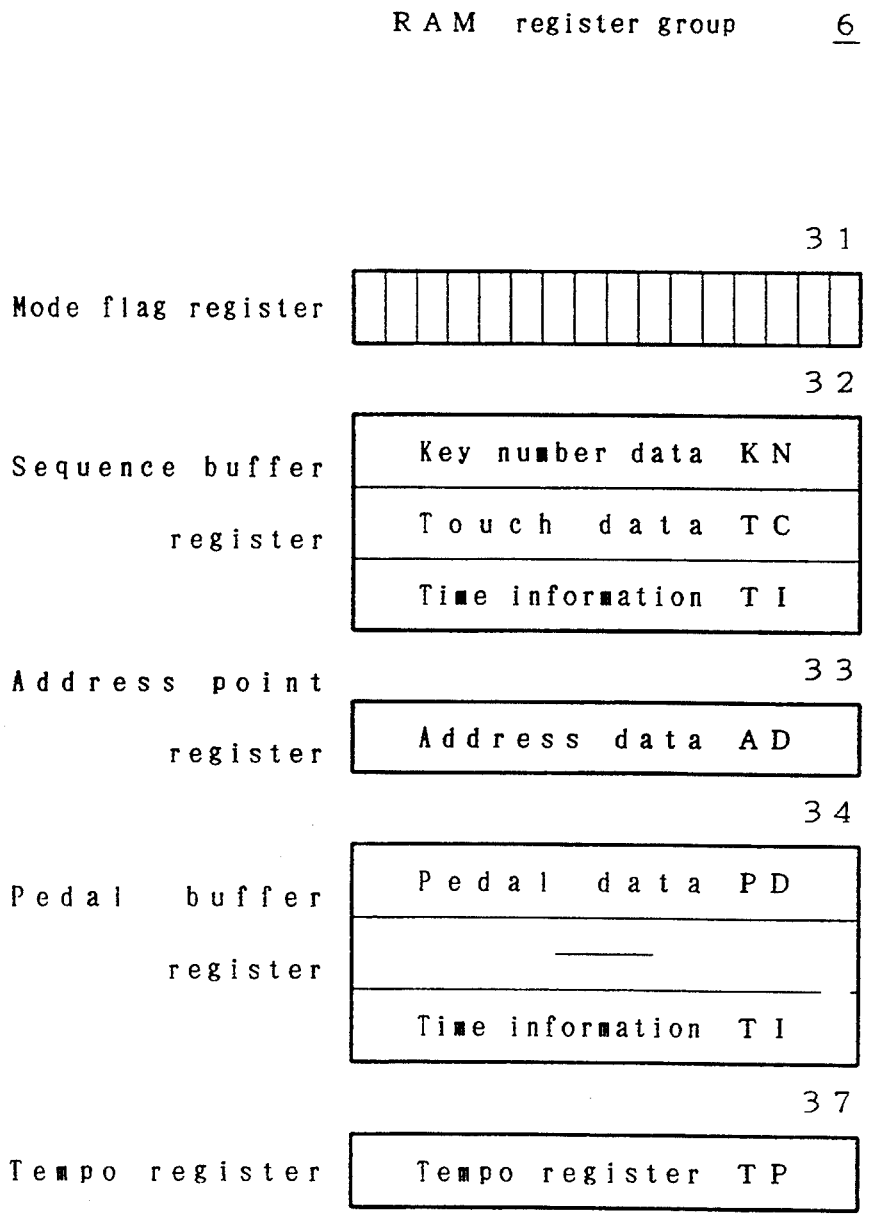
FIG. 3 is a view showing various registers of the RAM 6.

FIG. 3 shows various registers In the RAM 6. More specifically, in the RAM 6 are formed a mode flag register 31, a sequence buffer register 32, a pedal buffer register 33, an address point register 34 and a tempo register 37.

In the mode flag register 31 are stored flag data indicating the "on" state of each of the above pause key 20, rewind key 21, play key 22, forward key 23, record key 24 and stop key 25. The flag data has bits corresponding to each of the keys 20 to 25 which are "1" when set. When the pause key 20 is turned on for the first time, a pause flag is set, and when the key 20 is turned on again, the flag is cleared.

In the sequence buffer register 32 are temporarily stored the key number data KN, touch data TC and time information TI read out sequentially as a set from the autoplay information API. In the pedal buffer register 33 are temporarily stored pedal data PD and time information TI read out sequentially as a set from autoplay information API. In the address point register 34 is stored address data AD of autoplay information API indicating, an address in the RAM 6 to be accessed.

In the tempo register 31 is stored tempo data TP. The tempo data TP indicates a tempo input from the panel switch group 1. This data is supplied to the clock generator 11, which in turn outputs a clock signal $\phi$ at a frequency corresponding to the tempo data TP.

4. Key Routine

Figure 4:
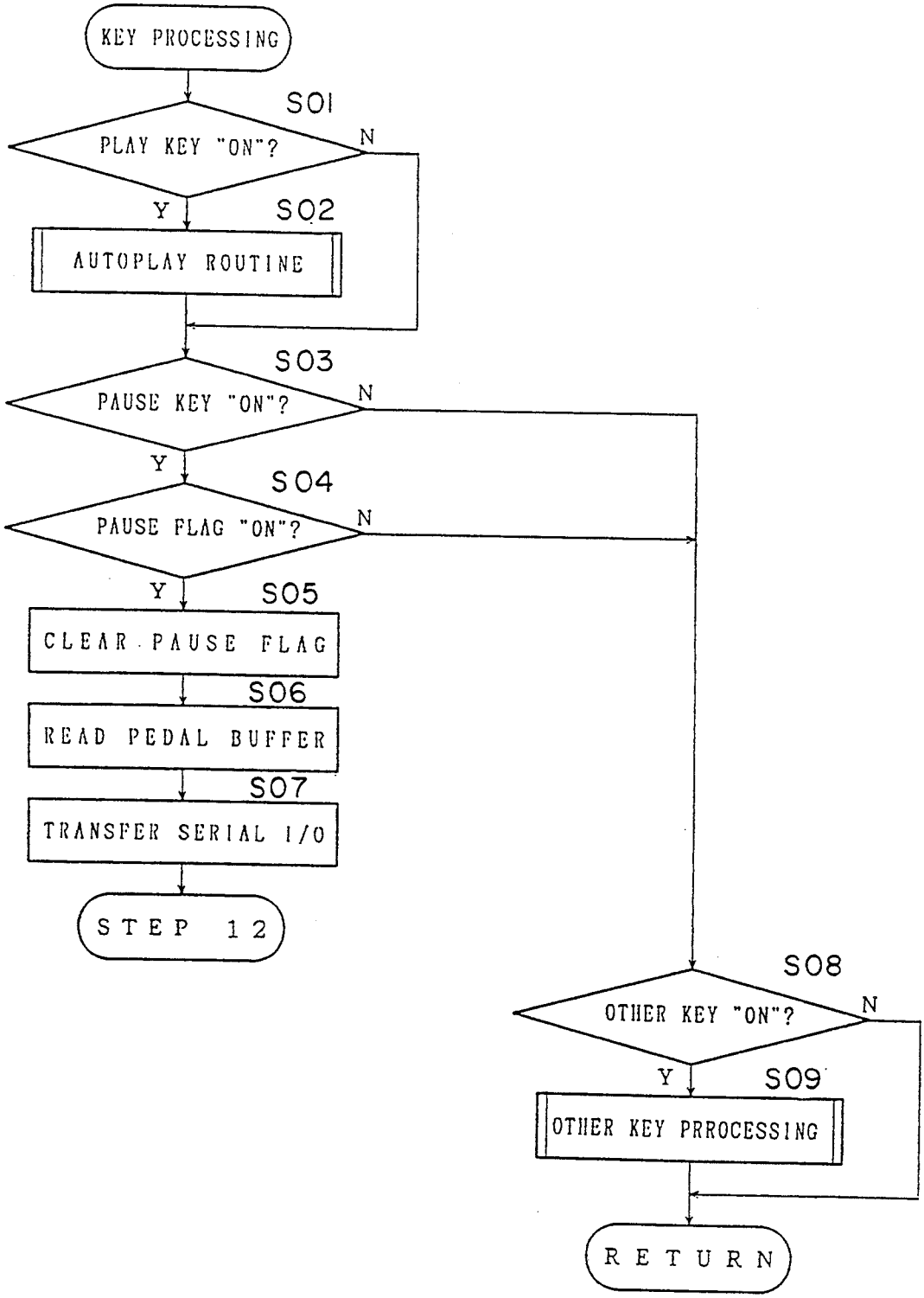
FIG. 4 is a flowchart of a key routine.

FIG. 4 is a flowchart of a key routine executed by the CPU 5. This routine is one of the main routines. The main routine is started when the power key is turned on, and the key routine is executed repeatedly after an initialization routine. In the initialization routine, all data in the time counter 10, play counter 12, RAM 6, input/output interface 2 and serial interface 3 are cleared.

When the play key 22 is turned on (step 01), an autoplay routine is executed (S02). The autoplay routine will be described later. Then, when the pause key 20 is turned on (03), a check is made as to whether a pause flag is set in the mode flag register 31 (04). When the pause key 20 is turned on a second time, if the pause of the autoplay is cancelled, then a pause flag has already been set.

In this case, the pause flag is cleared (05), and data corresponding to pedal data PD stored in the pedal buffer register 33 is read out (06) and supplied to the serial interface 3 (07). Then, the routine returns to the autoplay step 12.

Thus, when the pause key 20 is turned on for the second time, the pause of the autoplay is cancelled, the pedals 16 are returned to the state prior to the pause, and the autoplay is resumed automatically from the tone following the tone that sounded immediately before the pause.

If a key in the panel switch group 1 other than the keys noted above is found to be "on" (08), a routine corresponding to this key is executed (09). This routine includes selection of music on the floppy disk 8, loading/saving of autoplay information API, setting of the tempo TP and so forth.

5. Autoplay Routine

Figure 5:
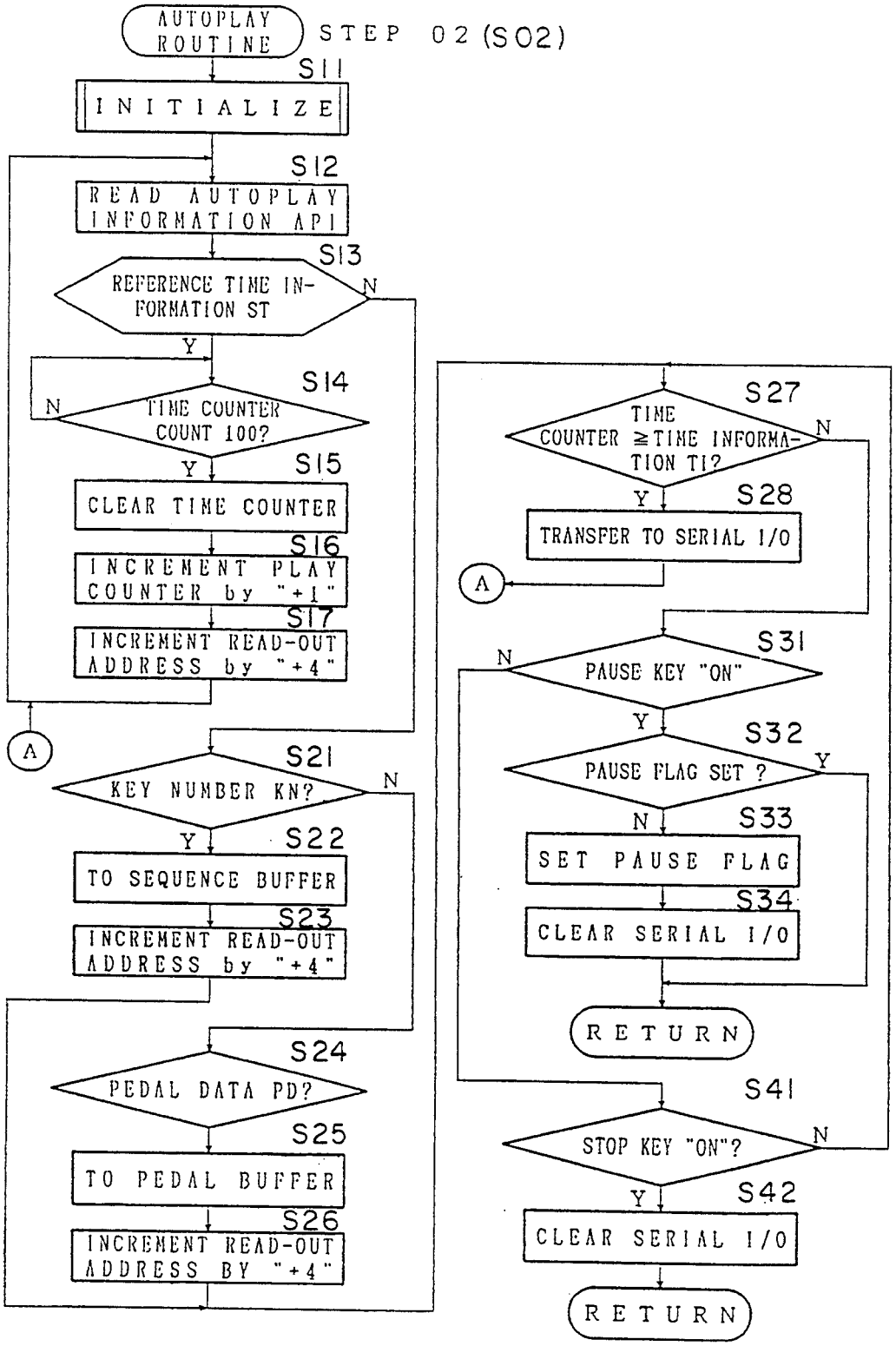
FIG. 5 is a flowchart of an autoplay routine (step 02)

FIG. 5 is a flowchart of the autoplay routine executed in the step 02 (S02) by the CPU 5. In this routine, autoplay routines are executed in accordance with the reference time information ST and key number data KN or pedal data PD of tile read-out autoplay information API (13 to 17, S21 to S23, S27 to S28 and S24 to S28). When the pause key 20 is turned on, a pause routine is executed (31 to 34). When the stop key 25 is turned on, a stop routine is executed (41 to 42).

First, an initialization routine is executed (step 11). In this routine, the sequence buffer register 32, pedal buffer register 33, address point register 34 and mode flag register 31 are cleared, and flag data "1" is set in the bit corresponding to the play key 22 of the mode flag register 31.

Then, autoplay information API set in the RAM 6 designated by address data AD of the address point register 34 is read out (12). If reference time information ST is read out (13), the routine is interrupted until the count of the time counter 10 becomes "100", that is, until reaching the timing corresponding to the reference time information ST (14). When the count of "100" in the time counter 10 is reached, the time counter 10 is cleared (15), the count of the play counter 12 is incremented by "+1" (16), the count of the address point register 34 is incremented by "+4" (17), and the routine returns to the step 12.

If the key number data KN, touch data TC and time information TI are read out (step 21), the data KN and TC and time information TI are set in the sequence buffer register 32 (22), and the count of the address point register 34 is incremented by "+4" (23). If the pedal data PD and time information TI are read out (24), these data PD and information TI are set in the pedal buffer register 33 (25), and the count of the address point register 34 is incremented by "+4" (26).

Then, the read-out time information TI and the progress time data PT in the time counter 10 are compared (27). If the progress time data PT is still less, the routine goes to step 31. If the progress time data PT becomes greater with the lapse of time, data corresponding to the music information MI in the sequence buffer register 32 or pedal buffer register 33 is supplied to the serial interface 3, whereby piano keys 15 or pedals 16 are automatically on-off operated (28).

In the step 31, a check as to whether the pause key 20 is "on" or "off" is made. If the pause key 20 is "on" (31), a check is made as to whether a pause flag is set in the mode flag register 31 (32). If the pause key 20 has been turned on for the first time, i.e., causing the autoplay to pause, then the pause flag has not been set.

Consequently, the pause flag is set in the mode flag register 31 (33), all the data supplied to the serial interface 3 is cleared (34), and the routine returns to the step 03. Thus, by turning on the pause key 20 once, the autoplay is paused, and the operation of the keys 15 and pedals 16 is completely released from being paused.

Thus, it is possible to prevent continuous operation of the solenoid for each key 15 or pedal 16, i.e., a continuous undesired operational state, during a pause. In this case, the operational status of the keys 15 and pedals 16 prior to the pause, are stored in the sequence buffer 32 and pedal buffer register 33, and are not cleared.

When the stop key 25 is turned on (41), the sending of music information MI to the serial interface 3 is stopped, all data that was supplied to the serial interface 3 is cleared (42), and the routine returns to the step 03.

If the play key 22 is turned on after turning on the pause key 20 once, the autoplay is restarted from the beginning of the music piece. In this case, however, the autoplay may also be resumed from a point immediately before the pause. For that purpose, the set/clear status of the pause flag in the mode flag register 31 is checked between the steps 01 and 02, and if the flag is set, the routine jumps to the step 05. If the flag is cleared, the routine goes to the step 02.

The autoplay routine in FIG. 5 is executed repeatedly until the pause key 20 or the stop key 25 is turned on. It is possible, however, to have the above routine executed only when the play key 22 is turned on, and proceed to the next routine when "NO" results in step 27. Further, it is possible to have an interrupt routine executed at a predetermined intervals to execute the step 27 of the autoplay routine shown in FIG. 5, returning to the initial routine if "NO" results in the step 27.

The counting in the time counter 10 and play counter 12 may be effected such that the tempo data TP in the tempo register 37 is accumulated in a separate counter, and when that counter overflows, the count of the time counter 10 is incremented by "+1". This routine is executed at fixed time periods independent of the tempo that has been set. In this case, however, the time counter 10 is incremented at a rate corresponding to the tempo, and the count is compared in the step 27 and cleared in the step 15. At this time, the play counter 12 is incremented by "+1".

6. Example of Pause Designation/Cancellation

Figure 6:
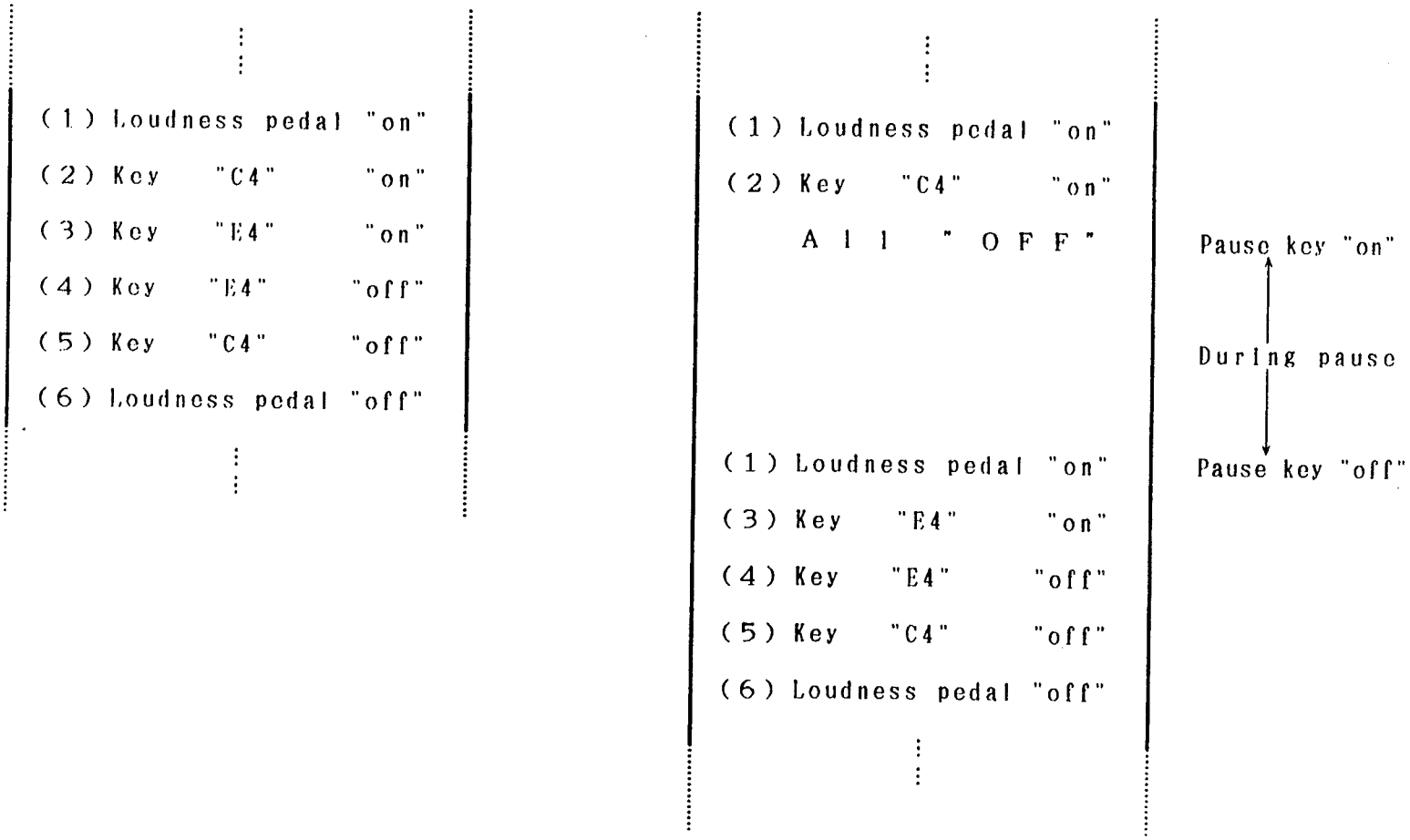
FIG. 6 is a view showing an example of designation and cancellation of a pause state.

FIG. 6 shows an example of the designation and cancellation of a pause. In this example, autoplay information API as shown in FIG. 6(A) is stored in the RAM 6. In the figure, the touch data TC is omitted. It is assumed here that music information MI (1) pedal 16 "on" and (2) key number C4 "on" is executed and the pause key 20 is turned on (step 31).

As a result, the operation of the pedal 16 and key 15 of "C4" is completely released once (34). At this time, the key number data KN etc., of "C4" remains stored in the sequence buffer register 32, and pedal data PD indicating pedal "on" etc., remains stored in the pedal buffer register 33. In this way, it is possible to prevent continuous operation of the solenoids 14 for the keys 15 and pedals 16, i.e., an undesired operational state, during the pause, When the pause key 20 is turned on again after a while (step 03), data corresponding to the pedal "on" data in the pedal buffer register 33 is supplied to the serial interface 3 (06 and 07) to cause resumption of the autoplay.

Afterwards, autoplay of (3) key number "E4" "on", (4) key number "E4" "off", (5) key number "C4" "off", and (6) pedal 16 "off" and is carried out. In this way, when the pause key 20 is turned on for the second time, the pause in the autoplay is cancelled, the keys 15 and pedals 16 are restored to the state that existed immediately before the pause, and the autoplay is automatically resumed from the tone immediately following the tone that sounded just before the pause.

In the key routine shown in FIG. 4, it is possible to have the next routine after the step 07 also be executed. That is, it is possible to have data corresponding to the key number data KN and touch data TC stored in the sequence buffer register 32 read out and supplied to the serial interface 3. Thus, with respect to the keys 15 as well, the autoplay is resumed automatically from the tone immediately following the tone that sounded just before the pause.

While an embodiment of the invention has been described, it is by no means limitative, and various changes and modifications are possible without departing from the scope of the invention. For example, if the capacity of the RAM 6 is large enough, the autoplay information API of all of a piece of music may be loaded at one time into the RAM 6. Further, while the pedal data PD comprises data on the type and on/off state of a pedal, it is possible to store plural bits of data indicating the extent of operation in lieu of the on/off data.

Further, it is possible to have the read-out address data AD for the RAM 6 decremented when the pause is cancelled. It is possible that if key number data KN Is found, it is written in the pedal buffer register 33 and sent out to the serial interface 3, and that if pedal data PD is found, it is written in the pedal buffer register 33 and sent out to the serial interface 3, the routine thus proceeding to the step 12.

Further, when autoplay is operating, it is possible for only the time information TI to be set in the register to be executed without using the sequence buffer register 32 and the pedal buffer register 33. In this case, by causing data to be transferred from the RAM 6 to the serial interface 3 in the step 28, when paused, data at the read-out point of the RAM 6 is transferred to the sequence buffer register 32 and pedal buffer register 33 between the steps 33 and 34. Further, it is possible to cause the read-out address data AD of the RAM 6 to be decremented, and have key number data KN written in the pedal buffer register 33 if it is found, and pedal data PD written in the pedal buffer register 33 if it is found.

Further, the sound generating/controlling means which controls the designation and cancelling of pause, may be foot switches, knee levers, benders, string instrument drivers, wind instrument drivers, percussion instrument drivers, etc., as well as the keys 15 and pedals 16. Further, the means for designating and cancelling pause is not limited to the pause key 20 but may be the stop key 25, or it may be a mute key, a masking key or any other means for stopping and resuming autoplay irrespective of its title. It may further be stop or start commands in the read-out autoplay information API or externally supplied MIDI type stop or start commands.

Further, the invention is also applicable to electronic musical instruments. In this case, in the routine of sending music information MI in the step 28, the music information MI is supplied to a tone generator or MIDI interface. In this case, the sound generating/controlling means noted above is provided in a musical instrument which is connected to the MIDI interface. The autoplay information API on the floppy disk 8 may include a stored signal detected by a key sensor from key operation of the autoplay piano, or data input from a computer. Further, it is possible to store the autoplay information API in a RAM/ROM card, a magnetic tape, a magnetic disk, an optical disk, etc,, as well as on the floppy disk 8 or in the RAM 6.

I claim:

1. An apparatus for autoplay comprising:

a plurality of sound generating/controlling means for sounding tones or controlling the sounding thereof:

tone information storing means for storing a plurality of pieces of tone information concerning the operational status of said sound generating/controlling means;

tone information reading means for reading out tone information from said tone information storing means in the order of the sequence of play;

tone processing means for supplying tone information read out by said tone information reading means to said plurality of sound generating/controlling means to have the plurality of sound generating-/controlling means sound tones or control the sounding thereof;

pause designation means for designating a pause in play;

stopping means for stopping the reading by said tone information reading means or the processing by said tone processing means according to the pause designation by said pause designation means;

operation storing means for storing the operational status of said sound generating/controlling means when said stopping means effects stopping;

operation releasing means for releasing the operation of said sound generating/controlling means in response to the stopping effected by said stopping means;

stop cancellation means for cancelling the stopping by said stopping means;

operation reading means for reading out the operational status of said sound generating/controlling means from said operation storing means in response to the stop cancellation effected by said stop cancellation means; and restoring means for informing the operational status of the sound generating/controlling means read out by said operation reading means to said sound generating/controlling means to restore the operation of the sound generating/controlling means to the status that existed immediately before the stopping effected by said stopping means.

2. The apparatus for autoplay according to claim 1, wherein said tone information storing means does not store any information when there is no change in said sound generating/controlling means and stores information when there is a change in said sound generating-/controlling means.

3. The apparatus for autoplay according to claim 1, wherein said sound generating/controlling means is pedals.

4. The apparatus for autoplay according to claim 1, wherein said sound generating/controlling means is provided on a musical instrument connected to said apparatus for autoplay.

5. The apparatus for autoplay according to claim 1, wherein said operation storing means has stored therein the operational status of said sound generating/controlling means before the stopping effected by said stopping means.

6. The apparatus for autoplay according to claim 1, wherein said pause designation means designates a pause in autoplay.

7. The apparatus for autoplay according to claim 1, wherein said stop cancellation means designates a start in autoplay.

8. A method of autoplay comprising the steps of:

(A) storing a plurality of pieces of tone information concerning the sounding or sounding control operation of a plurality of sound generating/controlling means for sounding tones or controlling the sounding thereof;

(B) reading out the tone information stored in the step (A) in the order of the sequence of the play;

(C) supplying the tone information read out in the step (B) to said plurality of sound generating/controlling means to cause sounding or control of sounding by the plurality of sound generating/controlling means;

(D) designating a pause in the play;

(F) stopping the reading in the step (B) or the routine in the step (C) according to the pause designation in the step (D);

(F) storing the operational status of said sound generating/controlling means when the stopping in the step (E) is effected;

(G) releasing the operation of said sound generating-/controlling means in response to the stopping effected in the step (E);

(H) cancelling the stopping in the step (E);

(I) reading out the operational status of said sound generating/controlling means according to the stopping cancellation in the step (H); and (J) informing the operational status read out in the step (I) to said sound generating/controlling means to restore the operation of the sound generating-/controlling means to the status that existed immediately before the stopping effected in the step (E).

9. The method of autoplay according to claim 8, wherein in said step (B) information is not stored When there is no change in said sound generating/controlling means and is stored when there is a change in said sound generating/controlling means.

10. The method of autoplay according to claim 8, wherein said sound generating/controlling means is pedals.

11. The method of autoplay according to claim 8, wherein in said step (F) the operational status of said sound generating/controlling means is stored before the stopping in said step (E) is effected.

12. The method of autoplay according to claim 8, wherein the pause designation in said step (D) is autoplay pause designation.

13. The method of autoplay according to claim 8, wherein the stop cancellation in said step (H) is a designation of the start of autoplay.

* * * * *